US005708949A

United States Patent [19]

Kasahara et al.

[11] Patent Number: 5,708,949

[45] Date of Patent: Jan. 13, 1998

[54] IMAGE FIXING DEVICE FOR IMAGE FORMING APPARATUS

[75] Inventors: Nobuo Kasahara, Yokohama; Yasuhiko Taguchi, Konosu; Katsuhiro Echigo, Asaka; Hiroyuki Shibaki, Kawasaki; Jun Yura, Yokohama, all of Japan

[73] Assignee: Ricoh Company, Ltd., Tokyo, Japan

[21] Appl. No.: 634,734

[22] Filed: Apr. 18, 1996

[30] Foreign Application Priority Data

| | | | |
|---|---|---|---|
| Apr. 18, 1995 | [JP] | Japan | 7-092814 |
| May 15, 1995 | [JP] | Japan | 7-115999 |
| Feb. 14, 1996 | [JP] | Japan | 8-026505 |

[51] Int. Cl.[6] ..... G03G 15/20

[52] U.S. Cl. ..... 399/330; 219/216

[58] Field of Search ..... 355/282, 285, 355/290; 219/216; 432/59, 60; 399/330

[56] References Cited

U.S. PATENT DOCUMENTS

| | | | |
|---|---|---|---|
| 4,009,953 | 3/1977 | Ravizza et al. | 355/290 |
| 4,050,803 | 9/1977 | McCarroll | 355/290 |
| 4,348,579 | 9/1982 | Namba | 219/216 |

*Primary Examiner*—Arthur T. Grimley

*Assistant Examiner*—Sophia S. Chen

*Attorney, Agent, or Firm*—Oblon, Spivak, McClelland, Maier & Neustadt, P.C.

[57] ABSTRACT

A fixing device incorporated in an image forming apparatus for fixing a toner image on recording paper, including a fixing roller in which a cylindrical core and a heater are installed in the roller, a pressure roller held in pressured contact with the fixing roller, and a reinforcing device used to preserve a cylindrical shape of the cylindrical core. The reinforcing device includes a circular plate and a contacting member which is provided along an edge of the circular plate and which has a contacting portion held in contact with an inner surface of the cylindrical core.

21 Claims, 15 Drawing Sheets

IMAGE FIXING DEVICE FOR IMAGE FORMING APPARATUS

BACKGROUND OF THE INVENTION

1. Field of the Invention

The present invention relates to an image fixing device such as a copier, printer or similar electrophotographic image forming apparatus. More particularly, the invention is concerned with a reinforcing structure for reinforcing a core of a fixing roller.

2. Discussion of Background

A fixing roller including heaters and a thin core has the advantage of reducing a period of time for reaching a fixing temperature and reducing electric power because a thermal capacity of the fixing roller is small. In reference to FIGS. 17 and 18 because the fixing roller 1001, which has the thin core, is weak, it is subject to bending as shown in FIG. 17, or squashing as shown in FIG. 18. If the fixing roller 1001 bends, a gap between the fixing roller 1001 and a pressure roller 1011 is formed, and therefore, its fixing ability is poor. If the fixing roller 1001 is squashed, it becomes damaged.

In order to solve the aforementioned drawbacks, Japanese Laid-Open Patent No. 61-59381 discloses a fixing roller in which plural reinforcing rings and ring supporting shafts are inserted for reinforcing the fixing roller. Japanese Laid-Open Patent No. 56-7949 discloses a fixing roller in which plural reinforcing ribs are inserted for reinforcing the fixing roller. These prior art references address and resolve the aforementioned drawbacks, because the mechanical strength of the fixing rollers is increased, but they each contain undesirable attributes that make them suboptimal for use in the field of the present invention.

The thermal capacity of the fixing roller disclosed in Japanese Laid-Open Patent No. 61-59381 becomes large because many reinforcing parts are inserted in the fixing roller. Further, because ring supporting shafts intercept light from a heater inserted in the fixing roller, the temperature of selected portions of the fixing roller is decreased.

The thermal capacity of the fixing roller shown in Japanese Laid-Open Patent No. 56-7949 becomes large because the reinforcing ribs are extended along an inside surface of the fixing roller.

SUMMARY OF THE INVENTION

Accordingly, it is an object of the present invention to provide an image fixing device for an image forming apparatus that solves the aforementioned drawbacks.

It is another object of this invention to provide a novel fixing roller that has suitable strength.

It is yet another object of the present invention to provide a novel fixing roller having a small thermal capacity.

In order to achieve the above-mentioned objects, according to the present invention, a fixing device for fixing a toner image on recording paper includes a fixing roller having a cylindrical core and a heater, a pressure roller held in press contact with the fixing roller, and a reinforcing device for keeping the cylindrical shape of the core. The reinforcing device includes a circular plate and a contacting member provided along an edge of the circular plate, the contacting member having a contacting portion held in contact with an inner surface of the cylindrical core.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 5(*b*) is a side sectional view of the reinforcing device of the present invention;

FIG. 6 is a graph representation showing surface temperature vs. time of a fixing roller after the heaters are turned on;

FIG. 7(*b*) is a side view of the second reinforcing device of the present invention;

FIG. 8(*b*) is a side view of the third reinforcing device of the present invention;

FIG. 9(*b*) is a front view of the fourth reinforcing device of the present invention;

FIG. 9(*c*) is a perspective view of the fourth reinforcing device of the present invention;

DESCRIPTION OF THE PREFERRED EMBODIMENTS

Figure 1:
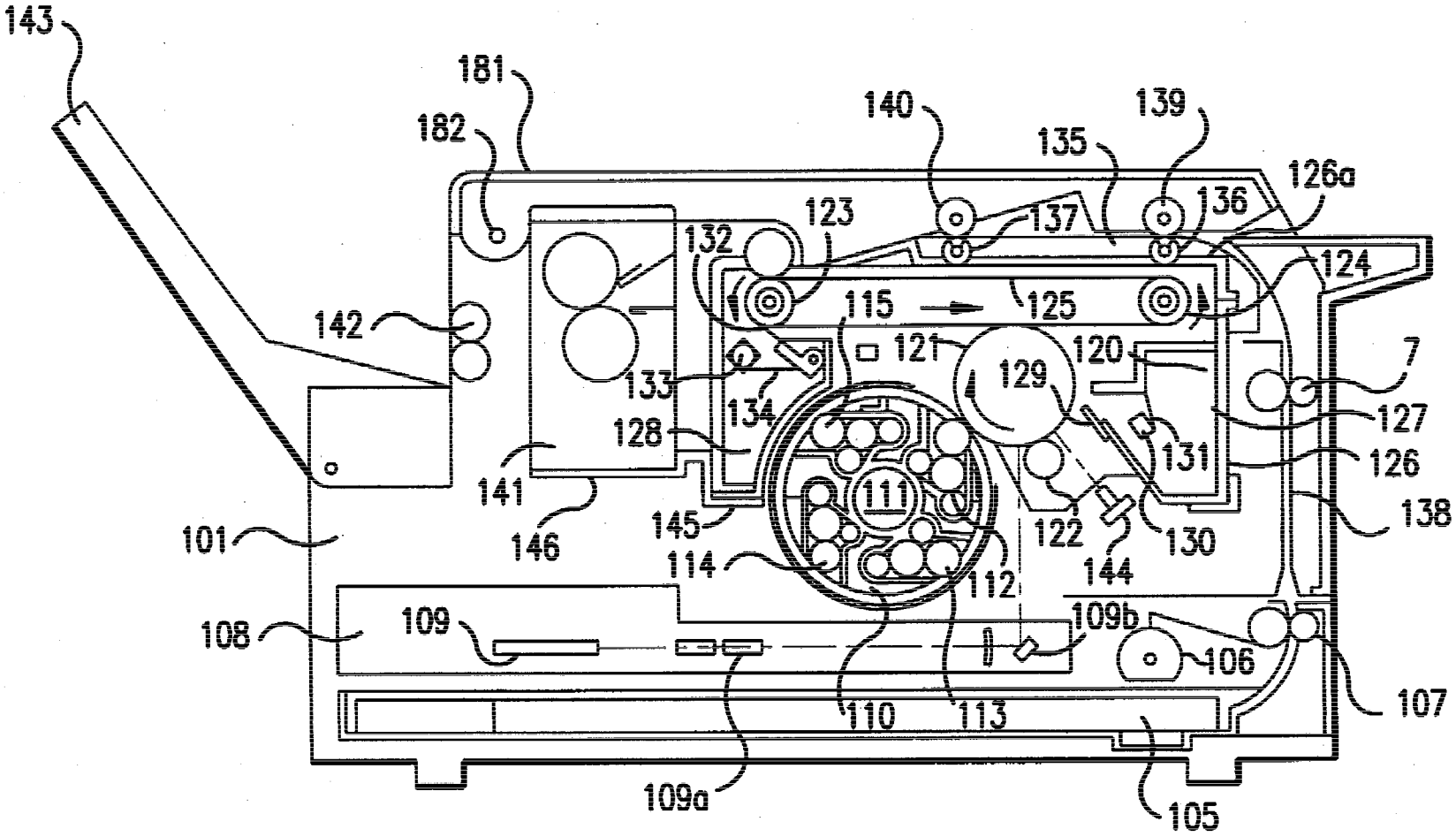
FIG. 1 is a front sectional view of a color image forming apparatus of a first embodiment of the present invention.
Figure 2:
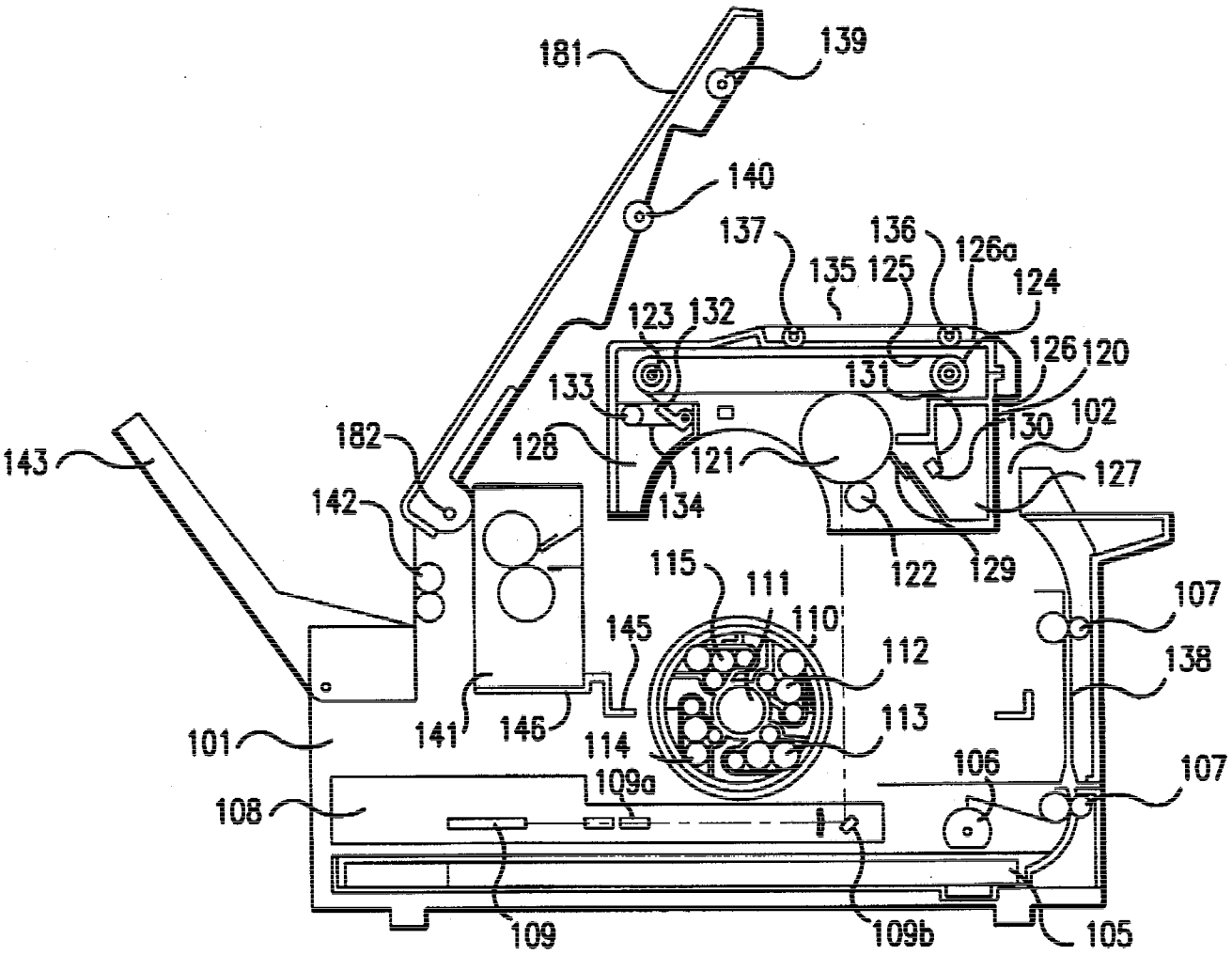
FIG. 2 is a view similar to FIG. 1, showing how a photoconductive element cartridge included in the first embodiment is replaced.

Referring now to the drawings, wherein like reference numerals designate identical or corresponding parts throughout the several views, and more particularly to FIGS. 1 and 2 thereof, a color image forming apparatus embodying the present invention is shown and includes a body 101. As shown in FIGS. 1 and 2, body 101 is formed with an opening 102 at the top thereof. A cover 181 is hinged to the body 101 opposite one edge of the opening 102 via a shaft 182. Also mounted on the body 101 are a sheet cassette 105, a pick-up roller 106 for pulling sheets out of the cassette 105 one by one, transport rollers 107 for conveying the sheet pulled out by the pick-up roller 106 and a latent image forming device 108. In the illustrative embodiment, the latent image forming device 108 is implemented by a laser for emitting a laser beam, a rotatable polygonal mirror 109 for steering the laser beam, an f-θ lens 109*a*, and a mirror 109*b*. The laser beam steered by the polygonal mirror 109 is projected onto a photoconductive element via the f-θ lens 109*a* and mirror 109*b*. Alteratively, the latent image forming device 108 may be constituted by the combination of light emitting elements and light converging conducting elements colinearly arranged.

A revolving-type developing device 110 is disposed above the latent image forming device 108. The developing device 110 is made up of a plurality of developing units 112, 113, 114, and 115 which are mounted on a shaft, or movable support 111. The developing units 112–115 each stores a developer of a particular color.

A photoconductive element cartridge 120 is located above the developing device 110. The cartridge 120 has a photoconductive element in the form of a drum 121, a charging member 122 held in contact with the drum 121, an intermediate transfer belt 125 which passes over a drive roller 123 and a driven roller 124 and is held in contact with the drum 121, and a casing or support 126 supporting elements 121–125. A lid 126*a* is mounted on the top of the casing 126 and may be opened. The casing 126 has a space 127 for collecting used toner from the drum 121, and a space 128 for collecting used toner from the belt 125.

The toner collecting space 127 accommodates a cleaning blade 129 held in contact with the drum 121, a member 130 for driving the toner scraped off by the blade 129 into the space 127, and a member 131 for removing the toner deposited on the member 130. Likewise, the other toner collecting space 128 accommodates a cleaning blade 132 held in contact with the belt 125, a member 133 for driving the toner scraped off by the cleaning blade 132 into the space 128, and a member 134 for removing the toner deposited on the member 133.

A transport path is formed on the top of the lid 126*a* of the casing to guide opposite edges of a sheet and is implemented by ribs. A transport roller 136 and a registration roller 137 are arranged on the transport path 135. The transport path 135 emerges from a sheet feed passage 138 which extends along one side of the body 101. A transport roller 139 and a registration roller 140 are mounted on the inner periphery of the cover 181 and held in contact with the above-mentioned transport roller 136 and the registration roller 137, respectively. A discharge lamp 144 is disposed in the cartridge 120 or in the casing 101 so as to dissipate the charge of the drum 121, as needed.

A fixing device 141, discharge rollers 142 and a tray 143 are also mounted on the body 101. The fixing device 141 fixes a toner image transferred from the belt 125 to a sheet being transported. The sheet having the image fixed thereon is driven out to the tray 143 by the discharge rollers 142. A bracket 145 supporting the cartridge 120, a bracket, not shown, supporting the developing device 110, and a bracket 146 supporting the fixing device 141 extend out from the body 101. The brackets 145 and 146, as well as the bracket not shown, are positioned on the body 101 such that the cartridge 120, the developing device 110 and the fixing device 141 can be removed in this order; the cartridge 120 is remote from the shaft 182 supporting the cover 181.

First Embodiment

Figure 3:
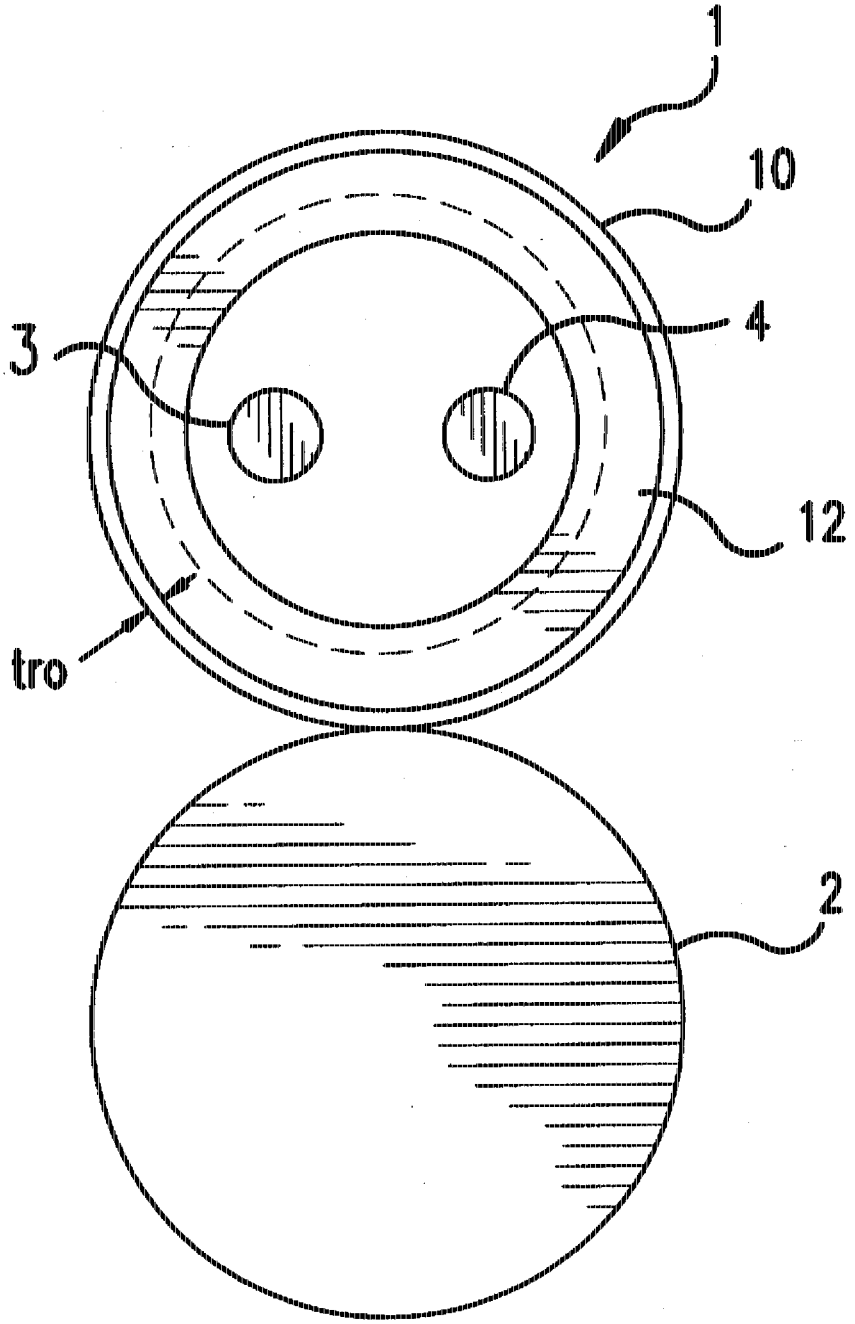
FIG. 3 is a front sectional view of a fixing device of the present invention.
Figure 4:
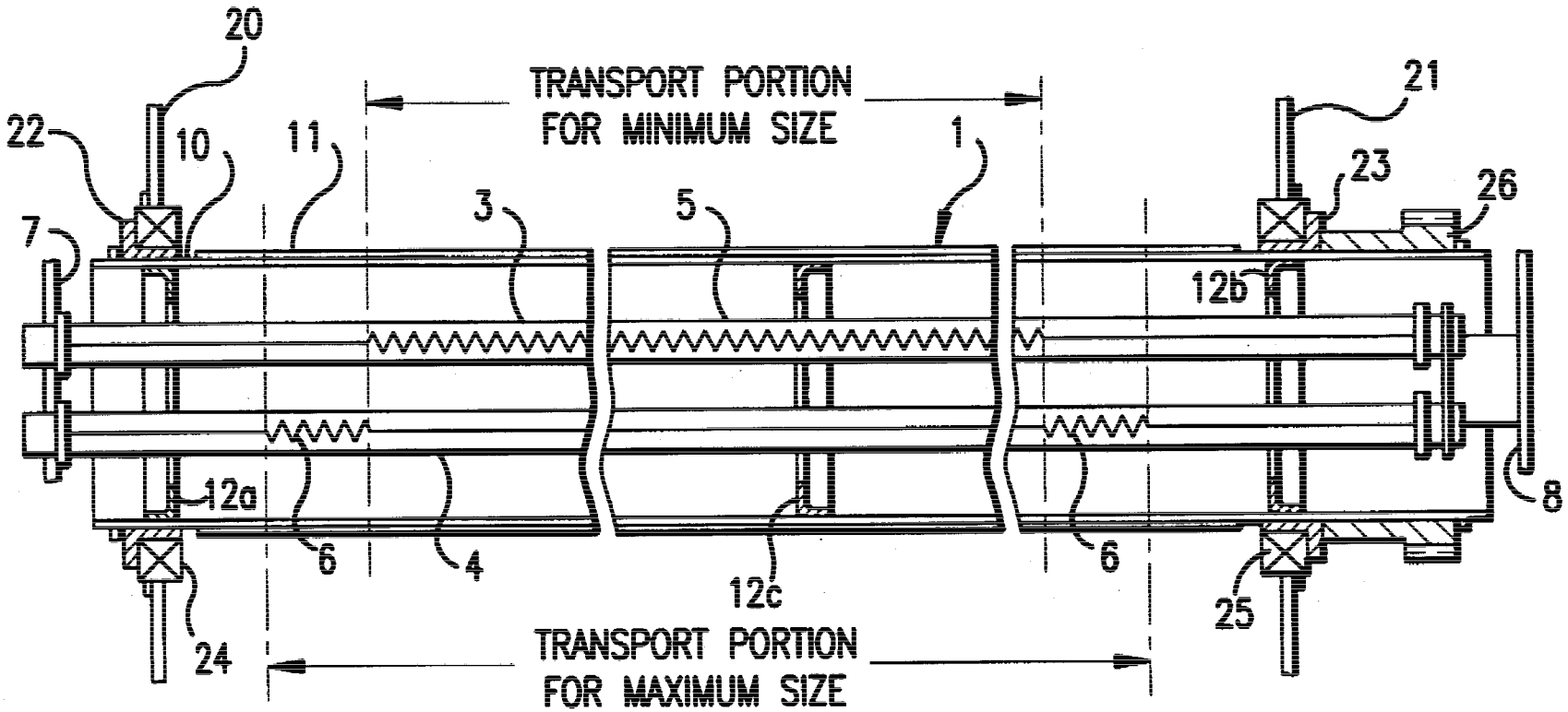
FIG. 4 is a transverse sectional view of a fixing roller of the present invention.

FIGS. 3 and 4 show the fixing device 141 of the first embodiment of the present invention. The fixing device 141 includes a fixing roller 1 and a pressure roller 2, which is held in pressured contact with the fixing roller 1. The fixing roller 1 includes a cylindrical metal core 10 which is made of iron, heaters 3 and 4 which are halogenous lamps, and an offset preventing layer 11 which is coated on the cylindrical metal core 10. It is also possible to adopt aluminum as the cylindrical metal core 10 instead of iron. The thickness of the wall of the cylindrical metal core 10 is from 0.3 mm to 0.8 mm, and the cylindrical metal core 10 has a diameter from 20 mm to 40 mm. The offset preventing layer 11 is made of a heat resisting material such as TEFLON (polytetrafluoroethylene). Because the heat capacity of the fixing roller 1 is very small, the temperature of the fixing roller 1 reaches a predetermined temperature within a short time and thus reduces the electric power consumed.

Both end portions of the heaters 3 and 4 are supported by holding devices 7 and 8 which are fixed on side plates 20 and 21 (although the positions where the holding devices are fixed are not illustrated). Each of heating portions 5 and 6 of the heaters 3 and 4 respectively heats a different area of the fixing roller 1 with respect to an axial direction of the fixing roller 1. In the present embodiment, sheets of various sizes are transported such that each center of each sheet passes through a center of the fixing roller 1 with respect to the axial direction of the roller 1. The heater 3 heats an area common to all of the transported sheets (large and small sheets alike) and the heater 4 heats other areas for larger sheets that may not have been heated by heater 3. The heater 3 is turned on when the smallest size of sheets are transported. Both of the heaters 3 and 4 are turned on when larger sheets of paper are transported.

Each of heat intercepting bushings 22 and 23 is inserted between each of bearings 24 and 25 and the cylindrical metal core 10 respectively. The fixing roller 1 is rotatably supported on the side plates 20 and 21 via the heat intercepting bushings 22 and 23 and bearings 24 and 25 in such a way that the fixing roller 1 rotates. A gear wheel 26 is provided on one side of the fixing roller 1 to transmit a driving force to the fixing roller 1. The heat intercepting bushings 22 and 23 prevent heat from transmitting from the cylindrical metal core 10 to the side plates 20 and 21.

Three reinforcing devices 12*a*, 12*b* and 12*c* act to keep a cross-sectional shape of the fixing roller 1 circular. Reinforcing devices 12*a* and 12*b* are positioned within cylindrical metal core 10 and proximate 25, respectively. The reinforcing device 12*c* is positioned in the middle between the bearings 24 and bearings 25.

Figure 5A:
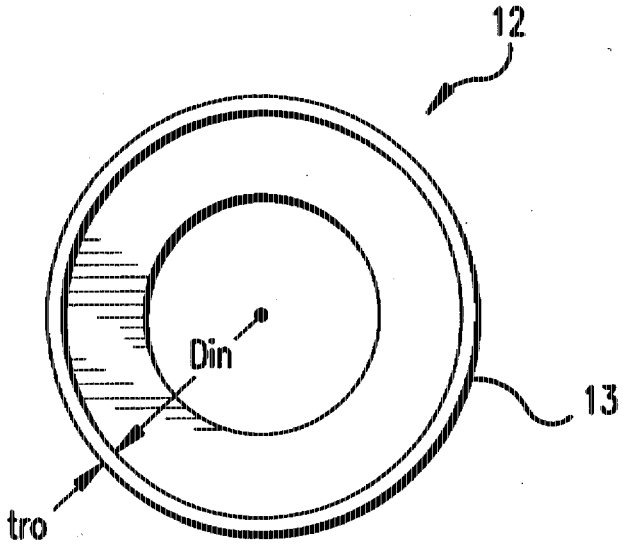
FIG. 5(*a*) is a front view of a reinforcing device of the present invention.
Figure 5B:
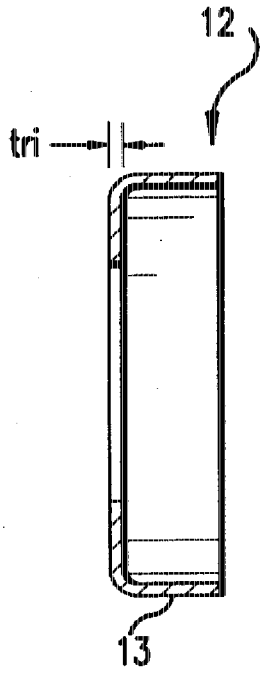

The reinforcing device 12 is a ring shaped device which is made from a thin plate as shown in FIGS. 5(*a*) and 5(*b*). The reinforcing device 12 has a contacting portion 13 which is held in contact with the inner surface of the cylindrical metal core 10 once inserted in the cylindrical metal core 10. Because the contacting portion 13 is tightly inserted in the cylindrical metal core 10, the reinforcing device 12 is held in place and neither falls down nor falls out of the cylindrical metal core 10. As a result, the use of reinforcing device 12 preserves the mechanical integrity and shape of fixing roller 1 such that fixing roller 1 does not bend or squash.

The thickness $t_{ri}$ of the reinforcing device 12 satisfies the following relationship.

$$t_{r0} \leqq t_{ri} \leqq 3t_{r0}$$

where $t_{r0}$ is the thickness of the wall of cylindrical metal core 10.

In the present embodiment, the cylindrical metal core 10 is preferably made of iron, has a diameter of 40 mm, and a wall thickness $t_{rO}$ of 0.3 mm. The reinforcing device 12 is preferably made of iron, and having a thickness $t_{ri}$ of 0.5 mm.

Figure 6:
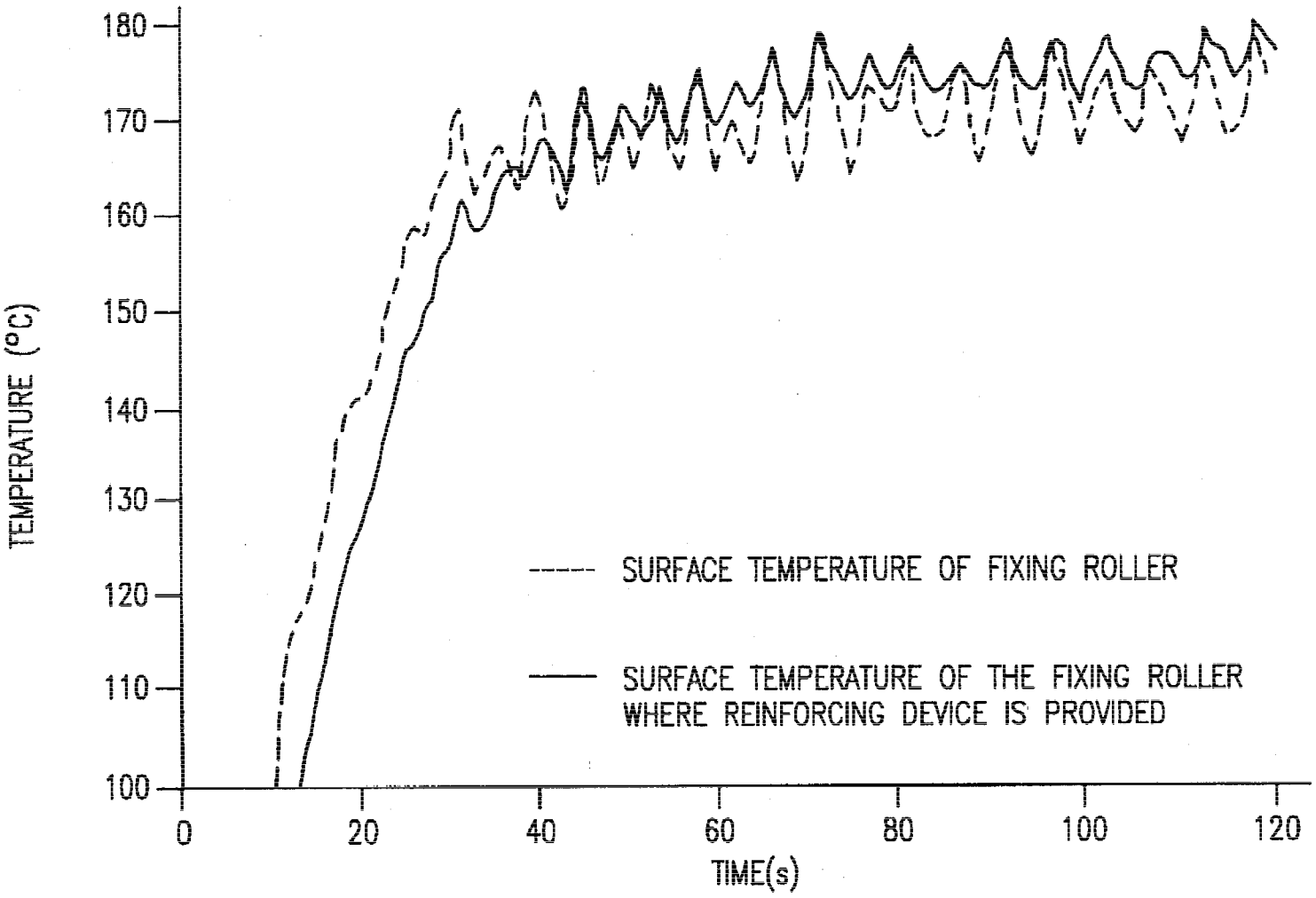

FIG. 6 shows a graph of surface temperature versus time of the fixing roller 1 after the heaters 3 and 4 are turned on. In FIG. 6, a solid line shows the surface temperature of the fixing roller 1 where the reinforcing device 12 is provided, and a dotted line shows the surface temperature of the fixing roller 1 where the reinforcing device 12 is not provided. As shown in FIG. 6, the surface temperature of the fixing roller 1 where the reinforcing device 12 is provided rises at the same rate as that of the fixing roller 1 where the reinforcing device 12 is not provided, but with a slight initial time offset. However, after the surface temperature of the fixing roller 1 reaches a predetermined temperature, the surface temperature of the fixing roller 1 where the reinforcing device 12 is not provided is the same as that of the fixing roller 1 where the reinforcing device 12 is provided. Thus, even though the reinforcing device 12 is provided in the cylindrical metal core 10, its ability to reach the predetermined surface temperature of the fixing roller 1 is comparable to that when the reinforcing device 12 is not provided. However, the reinforcing device 12 has the added advantage of improving the mechanical strength of the fixing roller 1, and therefore bending and squashing of the fixing roller 1 does not occur. It is clear the diameter and the thickness of the cylindrical metal core 10 is appropriate because during manufacturing the external shape of the cylindrical metal core 10, which is formed by turning the cylindrical metal core 10, does not bend.

Because the material of the reinforcing device 12 is the same as that of the cylindrical metal core 10, a thermal expansion coefficient of the reinforcing device 12 is the same as that of the cylindrical metal core 10. Therefore, even if the temperature of the fixing roller 1 changes, the reinforcing device 12 remains seated within the cylindrical metal core 10 and does not push too much against the cylindrical metal core 10 such that it damages the cylindrical metal core 10. Further, damage is prevented during manufacturing, for example when the cylindrical metal core 10 is shaven, or when a TEFLON coating is applied to the cylindrical metal core 10, or when an inner surface of the cylindrical metal core 10 is painted. Even if the temperature of the fixing roller 1 rises, the manufacturing process for the fixing roller 1 is carried out without risk of damaging the fixing roller 1 because the thermal expansion coefficient of the reinforcing device 12 is the same as that of the fixing roller 1.

Second Embodiment

In a second embodiment, the reinforcing device 12 is made of aluminum, which has a smaller heat capacity than that of iron; specific heat capacity of aluminum is sixty percent of that of iron. The fixed position of the reinforcing device 12 in the cylindrical metal core 10 and the thickness of the reinforcing device 12 of the second embodiment is the same as that of the first embodiment. Specific heat capacity is an inherent constant in for any given material. Specific heat capacity is obtained for any given object by multiplying its inherent specific heat by its density. In the second embodiment the heat capacity of the reinforcing device 12, which is made of aluminum, is small, such that the surface temperature of the fixing roller 1 reaches a predetermined temperature in a short time. Further, thermal conductivity of aluminum is so large that the surface temperature of the fixing roller 1 becomes constant, even if the reinforcing device is provided in the cylindrical metal core 10.

Third Embodiment

In a third embodiment, a thermal expansion coefficient of the reinforcing device 12 is larger than that of the cylindrical metal core 10, but the thickness of the cylindrical metal core is such that it can bear thermal stress generated by thermal expansion of the reinforcing device. Namely, stress $\sigma\theta$, measured in a circumference direction of the cylindrical metal core 10, satisfies the following equation:

$$\sigma\theta=\sigma_{th}\times D_{in}/2t_{rO} \quad (1)$$

where $t_{rO}$ is the wall thickness of the cylindrical metal core 10, $D_{in}$ is an inner diameter of the cylindrical metal core 10, and $\sigma$th is thermal stress of the reinforcing device 12. In order to prevent a transformation (i.e., an alteration in shape) of the fixing roller 1, it is necessary that the stress $\sigma\theta$ should satisfy the following equation:

$$3\times\sigma\theta<\sigma_s \quad (2)$$

where 3 is a constant which shows a safety coefficient, and $\sigma_s$ is the yield stress of the cylindrical metal core 10.

Furthermore, in order to prevent the transformation of the fixing roller 1, it is necessary that the wall thickness of the cylindrical metal core 10 $t_{rO}$ should satisfy the following equation:

$$t_{rO}>3\times\sigma_{th}\times D_{in}/(2\times\theta_s) \quad (3)$$

In the third embodiment, the cylindrical metal core 10 is made of iron, and the reinforcing device 12 is made of aluminum, which has a thermal expansion coefficient greater than that of iron. A linear expansion factor of iron is $1.16\times10^{-5}$/K, and that of aluminum is $2.38\times10^{-5}$/K. A diameter of the cylindrical metal core 10 is 40 mm, its thickness is 0.4 mm, and its inner diameter is equivalent to the diameter of reinforcing device 12. If the fixing roller 1 is heated to 185° C. (indoor temperature is 25° C.), the inner diameter of is the cylindrical metal core 10 becomes 39.48 mm by thermal expansion. Because the reinforcing device 12 also expands, it presses the inner surface of the cylindrical metal core 10 at the thermal stress $\sigma_{th}$, 0.17 kgf/mm$^2$. The stress $\sigma\theta$ acts in a circumference direction on the cylindrical metal core 10, and is 8.4 kgf/mm$^2$, as found from equation (2). When the yield stress $\sigma_s$ of iron is 30 kgf /mm$^2$, the aforementioned conditions satisfies equation (3). Therefore, if the fixing roller is heated from 150° C. to 200° C., the fixing roller 1 will not be transformed.

Fourth Embodiment

Figure 7A:
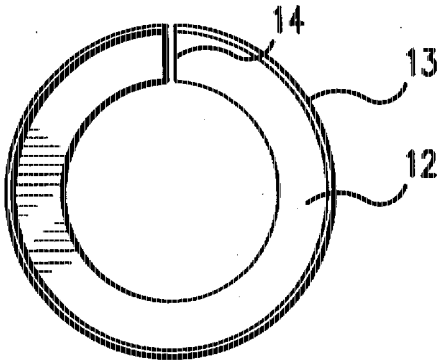
FIG. 7(*a*) is a front view of a second reinforcing device of the present invention.
Figure 7B:
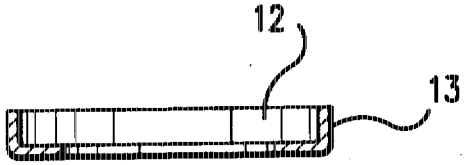

In a fourth embodiment, the shape of the reinforcing device 12 of the first embodiment is modified, but the other conditions of the reinforcing device of the first embodiment remain the same. Referring to FIGS. 7(*a*) and 7(*b*), a slit 14 is formed on the reinforcing device 12. Because the slit 14 is formed on the reinforcing device 12, the reinforcing device 12 is easily inserted into the cylindrical metal core 10.

Figure 8A:
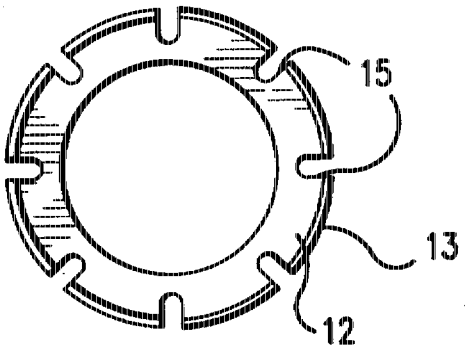
FIG. 8(*a*) is a front view of third reinforcing device of the present invention.
Figure 8B:
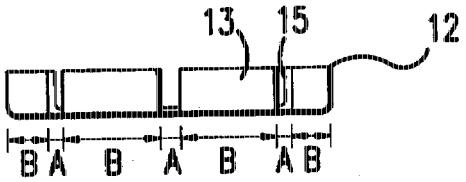

It is also possible to make more than one slit 15 on a contacting portion 13 as shown in FIGS. 8(*a*) and 8(*b*). In the fourth embodiment, eight slits are formed on the contacting portion 13 at equal intervals B, each slit having an equal width A. Since the interval B is longer than the width A, the mechanical strength of the reinforcing device 12 is sufficient. As a result, the reinforcing device 12 can easily be inserted in the cylindrical metal core 10. Further, because more than one slit is formed, the reinforcing device 12 can be made by pressing a metal plate in a manufacturing process.

The reinforcing device 12 is preferably fixed to the cylindrical metal core 10 by means of a heat resisting adhesive. While other fixing means are considered, if the adhesive is used for fixing the reinforcing device 12 to the cylindrical metal core 10, the tolerance of the diameter of the contacting portion 13 need not be as strict as other contacting portions where the reinforcing device is fixed without adhesive. Therefore, the reinforcing device 12 is easily inserted in the cylindrical metal core 10.

Fifth Embodiment

Figure 9A:
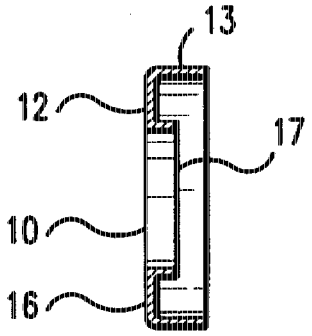
FIG. 9(*a*) is a side view of a fourth reinforcing device of the present invention.
Figure 9B:
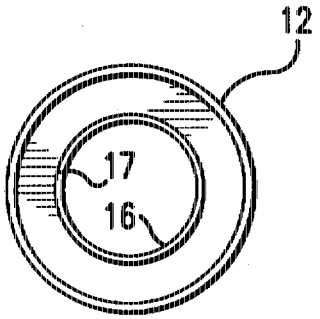
Figure 9C:
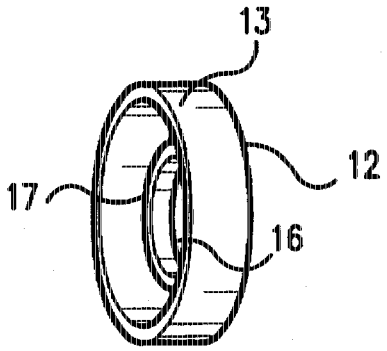

In a fifth embodiment, the shape of the reinforcing device 12 of the first embodiment is modified, but the other conditions of the reinforcing device of the first embodiment are the same. Referring to FIGS. 9(*a*), 9(*b*) and 9(*c*), a pressing portion 17 is formed on an inner edge of an inner plane surface 16 of the reinforcing device 12. A contacting portion 13 of the reinforcing device 12 is in pressured contact with the inner surface of the cylindrical metal core 10, and therefore, the reinforcing device 12 is fixed to the cylindrical metal core 10. Because the pressing portion 17 is formed on the inner plane surface 16, the reinforcing device 12 can bear against stress concentrated on the inner plane surface 16 when the pressure roller 2 presses the fixing roller 1. As a result, the mechanical strength of the fixing roller 1 is increased.

Sixth Embodiment

Referring to features of the first embodiment as shown in FIG. 4, a temperature of the both side areas of the fixing roller 1 relative to the axial direction of the fixing roller 1 is lower than that of a middle area of the fixing roller 1. In order to reduce a temperature difference between both side areas and the middle area, the heat capacity of the reinforcing devices 12*a* and 12*b*, which are provided in the side areas, in a sixth embodiment is made smaller than that of the reinforcing device 12*c* which is provided in the middle area. Therefore, a quantity of radiant heat from the reinforcing devices 12*a* and 12*b* is smaller than that from the reinforcing device 12*c*. As a result, the temperature difference between both side areas and the middle area is reduced. In order to reduce the heat capacity of the reinforcing devices 12*a* and 12*b*, the thickness of the reinforcing devices 12*a* and 12*b* is made thinner than that of the reinforcing device 12*c*.

It is also possible to provide the reinforcing devices 12*a* and 12*b* where slit 15 is formed as shown in FIGS. 8(*a*) and 8(*b*).

Referring to FIG. 4, the reinforcing devices 12*a* and 12*b* are provided outside of the heating portion 6 of the heater 4. According to this structure, radiant heat from both sides of the fixing roller 1 is reduced by means of the reinforcing devices 12*a* and 12*b*. It is desirable that an inner diameter of the reinforcing devices 12*a* and 12*b* is made smaller than that of the reinforcing device 12*c*, since an area of the reinforcing devices 12*a* and 12*b* for radiating the heat is smaller than that of the reinforcing device 12*c*. In order to reduce the area of the reinforcing devices 12*a* and 12*b*, an adiabatic member (known in the art) having a small heat capacity is fixed (in a way known in the art) to the reinforcing devices 12*a* and 12*b* away from the heaters 3 and 4. According to this structure, not only is the temperature difference between both side areas and the middle area reduced, but the thermal efficiency of the heaters 3 and 4 becomes high and thus consumes less electric power.

Seventh Embodiment

Figure 10:
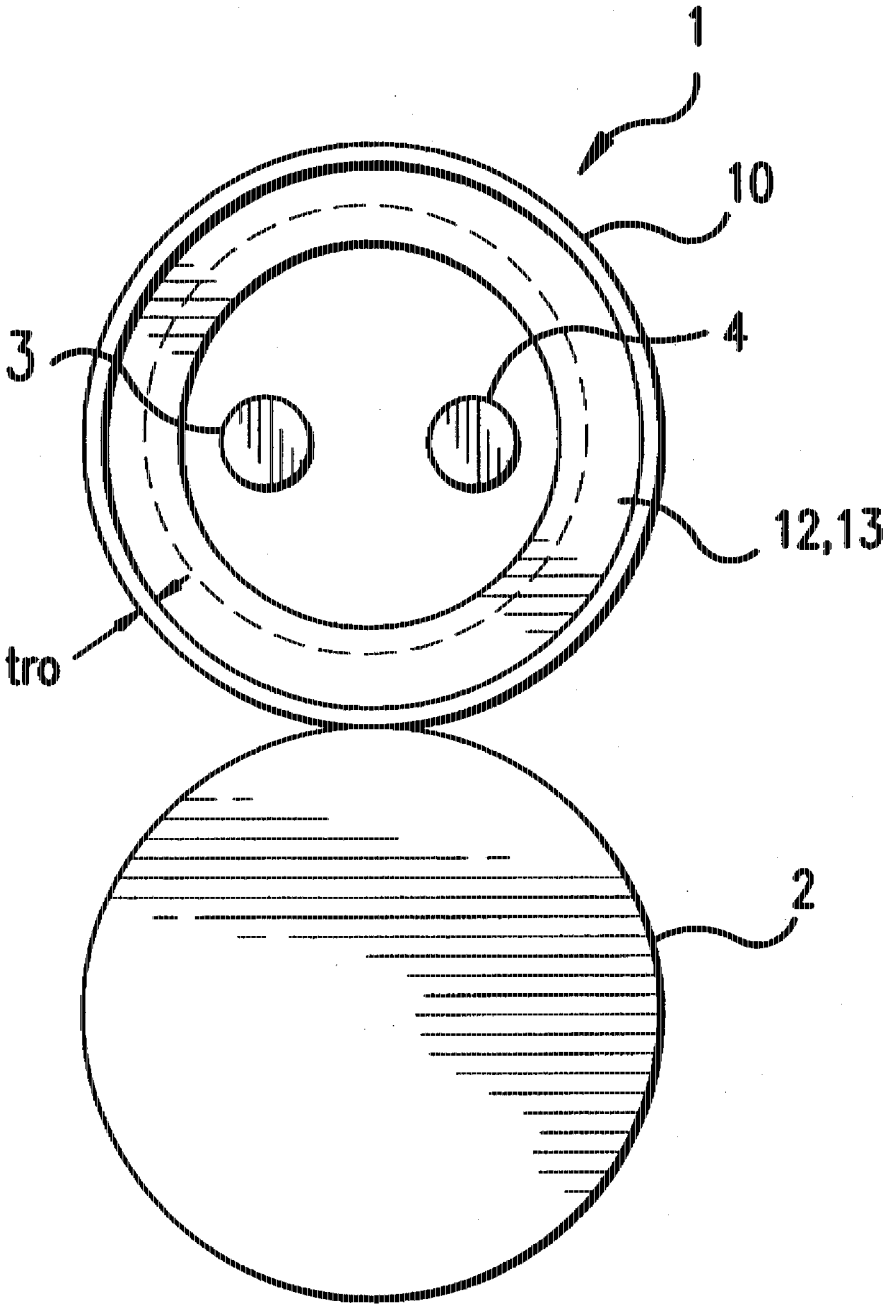
FIG. 10 is a front sectional view of a second fixing device of the present invention.
Figure 11:
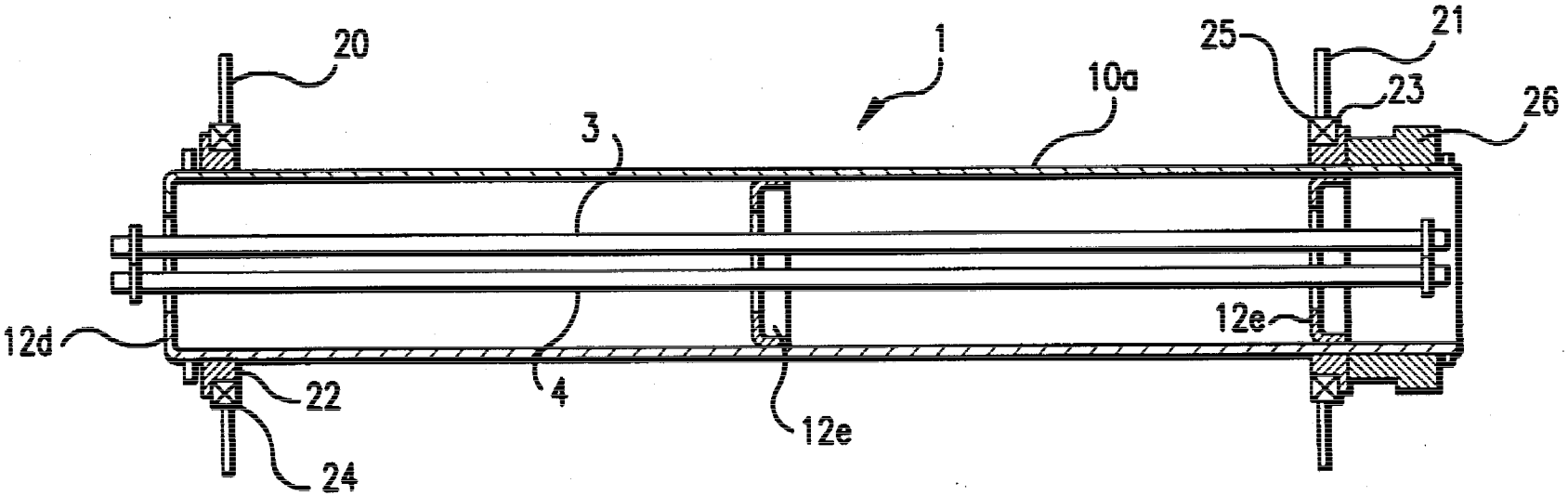
FIG. 11 is a transverse sectional view of the second fixing roller of the present invention.

FIGS. 10 and 11 show relevant aspects of the seventh embodiment of the present invention. Referring to FIGS. 10 and 11, reinforcing devices 12 are provided in the fixing roller 1. A reinforcing device 12*d* is formed as part of cylindrical metal core 10*a*. Reinforcing device 12 is formed by pressing the left end of the cylindrical metal core 10*a* to create the structure shown in FIG. 11. Openings are formed on a central portion of the reinforcing device 12*d* where heaters 3 and 4 are inserted. The openings are small so that radiation of heat is prevented. Reinforcing devices 12*e* is the same as the fourth embodiment as shown in FIGS. 7(*a*) and 7(*b*). According to the seventh embodiment, because it is not necessary to insert the reinforcing device 12*d*, productivity efficiency of the fixing roller 1 is increased.

Eighth Embodiment

Figure 12:
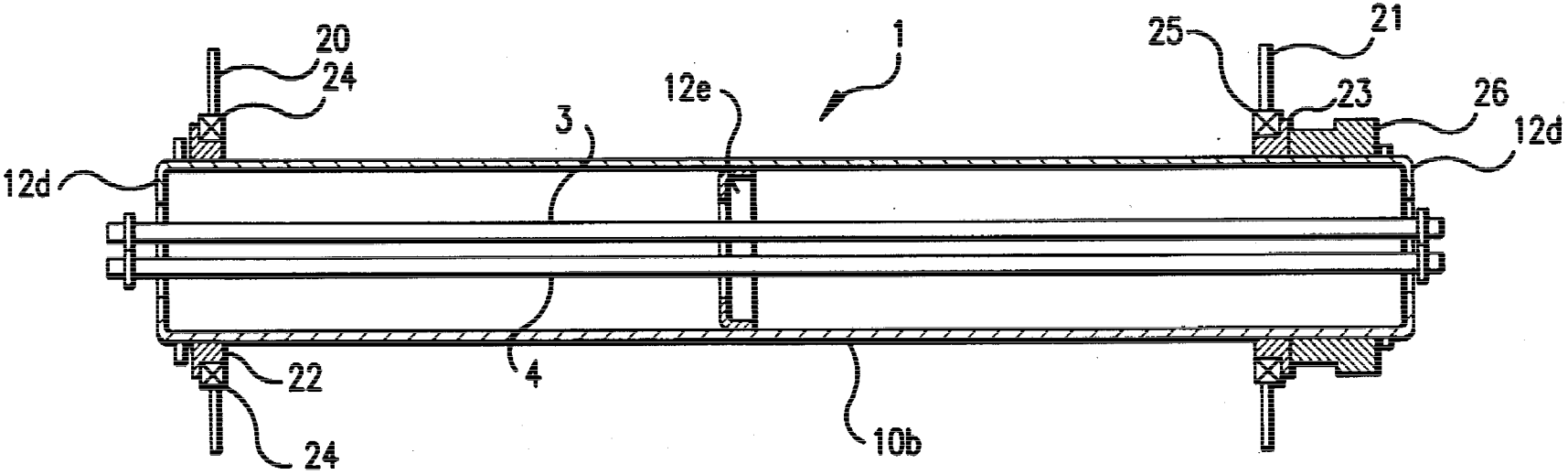
FIG. 12 is a transverse sectional view another a third fixing roller of the present invention.

FIG. 12 shows relevant aspects of an eighth embodiment of the present invention. Referring to FIG. 12, reinforcing devices 12 are provided in the fixing roller 1. Reinforcing devices 12*d* are formed on cylindrical metal core 10*b* by pressing both sides of the cylindrical metal core 10*b* in a manner like that described in the seventh embodiment. Openings are formed on a central portion of each of the reinforcing devices 12*d* where heaters 3 and 4 are inserted. The openings are small so that radiation of heat is prevented. The structure of the reinforcing device 12*e* is the same as the fourth embodiment as shown in FIGS. 7(*a*) and 7(*b*). The reinforcing device 12*e* is fixed at a center location center between bearing 24 and bearing 25.

According to the eighth embodiment, because it is not necessary to insert the reinforcing devices 12*d*, productivity efficiency of the fixing roller 1 is increased. Further, the operational efficiency of the fixing roller 1 is increased because radiation of heat from the fixing roller 1 is prevented by means of the reinforcing devices 12*d*.

Ninth Embodiment

Figure 13:
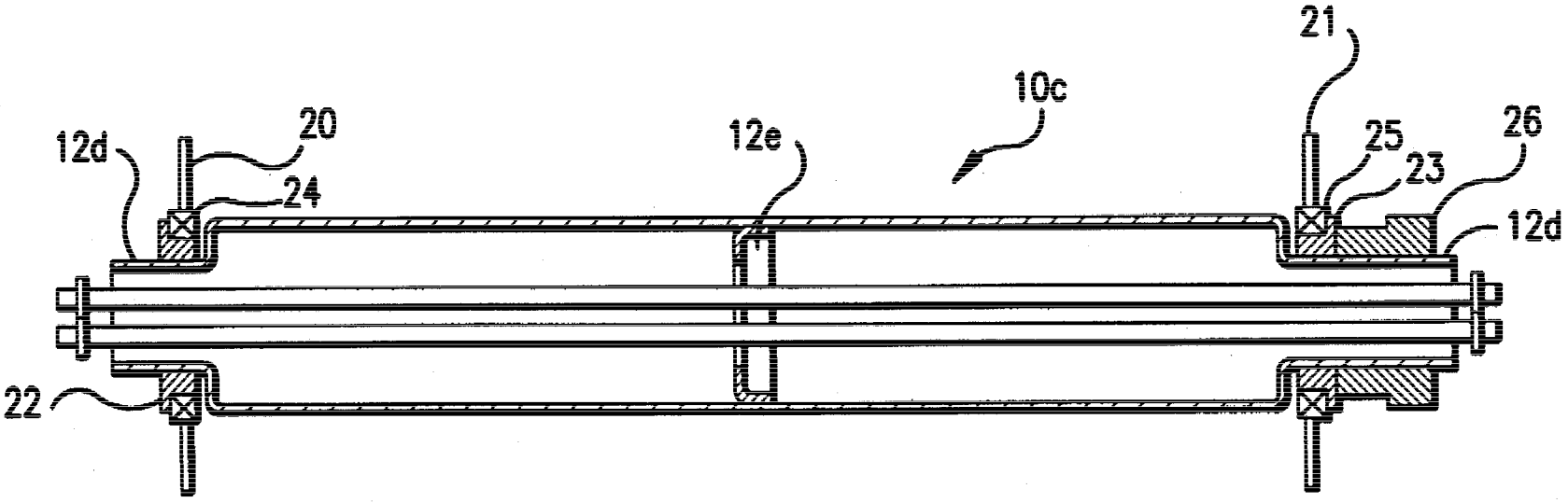
FIG. 13 a transverse sectional view of a fourth fixing roller of the present invention.

FIG. 13 shows relevant aspects of a ninth embodiment of the present invention. Referring to FIG. 13, reinforcing devices 12*d* are formed on cylindrical metal core 10*c* by pressing both sides of the cylindrical metal core 10*c*. Openings are formed in a central portion of each of the reinforcing devices 12*d* where heaters 3 and 4 are inserted. The openings are small so that radiation of heat is prevented. In the ninth embodiment, diameters of the reinforcing devices 12*d* are smaller than the cylindrical metal core 10*c*. Because the diameters of the reinforcing devices 12*d* are smaller than that of the central portion of cylindrical metal core 10*c*, at a location where it receives weight from the bearings 24 and 25, the mechanical strength of the fixing roller 1 is increased. Further, the heat capacity of the reinforcing devices 12*d* becomes small due to their smaller size. The structure of a reinforcing device 12*e* is the same as the fourth embodiment as shown in FIGS. 7(*a*) and 7(*b*). The reinforcing device 12*e* is fixed a center position between bearing 24 and a bearing 25.

Tenth Embodiment

Figure 14:
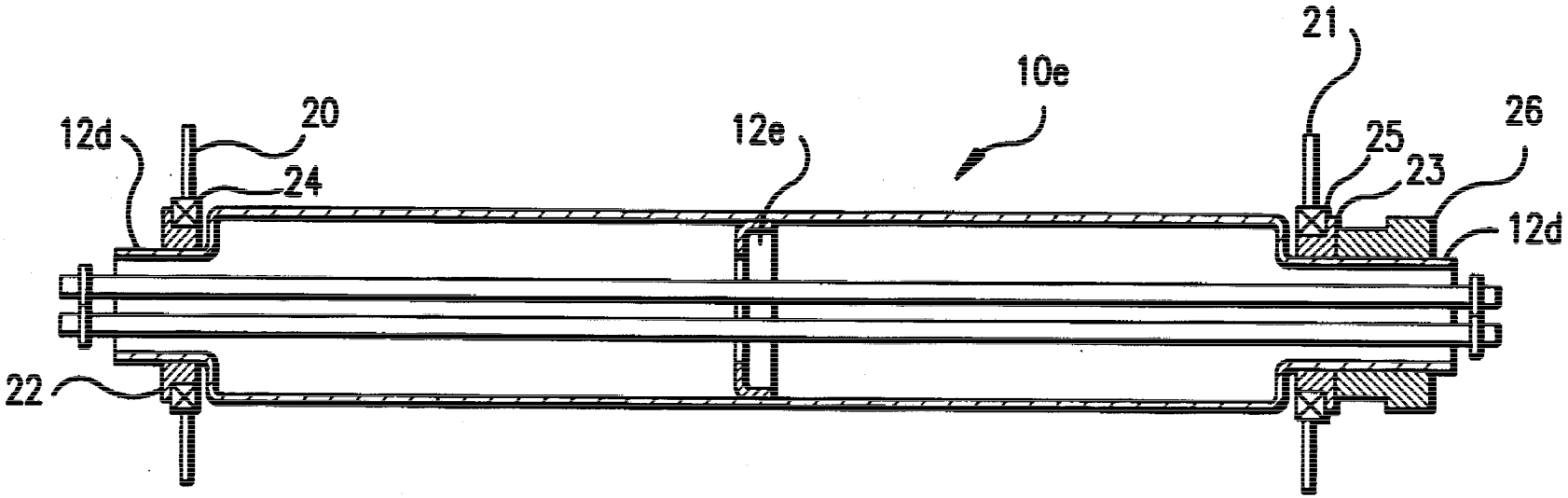
FIG. 14 is a transverse sectional view of a fifth fixing roller of the present invention.

FIG. 14 shows relevant aspects of a tenth embodiment of the present invention. Reinforcing devices 12*d* are formed on cylindrical metal core 10c by pressing both sides of the cylindrical metal core 10c. Openings are formed in a central portion of each of the reinforcing devices 12d where heaters 3 and 4 are inserted. The diameters of the openings are small so that radiation of heat is prevented. In the present embodiment, diameters of the reinforcing devices 12d are smaller than the cylindrical metal core 10c, and the cross-sectional thickness of the reinforcing devices 12d are thicker than that of the walls of cylindrical metal core 10e. Because the diameters of the reinforcing devices 12d are smaller than that of the central portion of cylindrical metal core 10c, at a location where it receives weight from the bearings 24 and 25, and of the reinforcing devices 12d are thick, the mechanical strength of the fixing roller 1 is increased. Further, the heat capacity of the reinforcing devices 12d becomes small due to their smaller size. The structure of a reinforcing device 12e is the same as the fourth embodiment as shown in FIGS. 7(*a*) and 7(*b*). The reinforcing device 12e is fixed a center location between bearing 24 and bearing 25.

Figure 15:
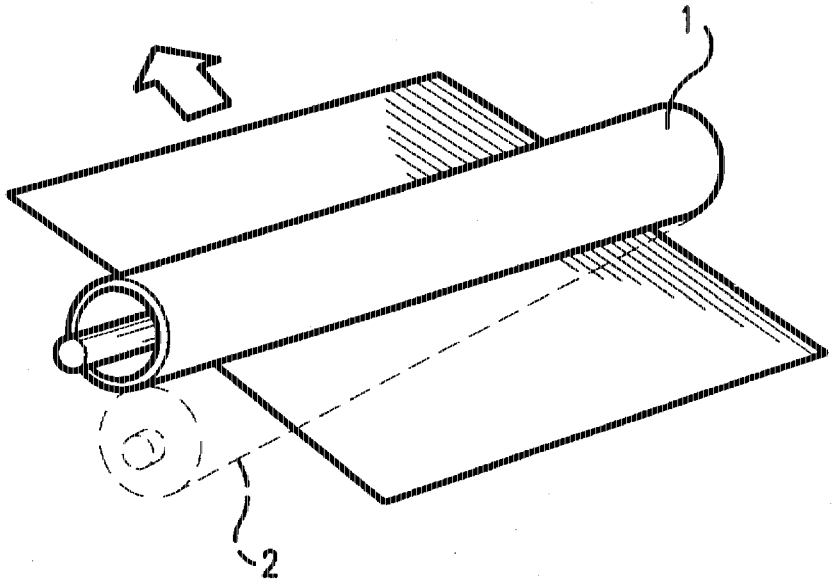
FIG. 15 is a schematic perspective view of a fixing device of the present invention.
Figure 16:
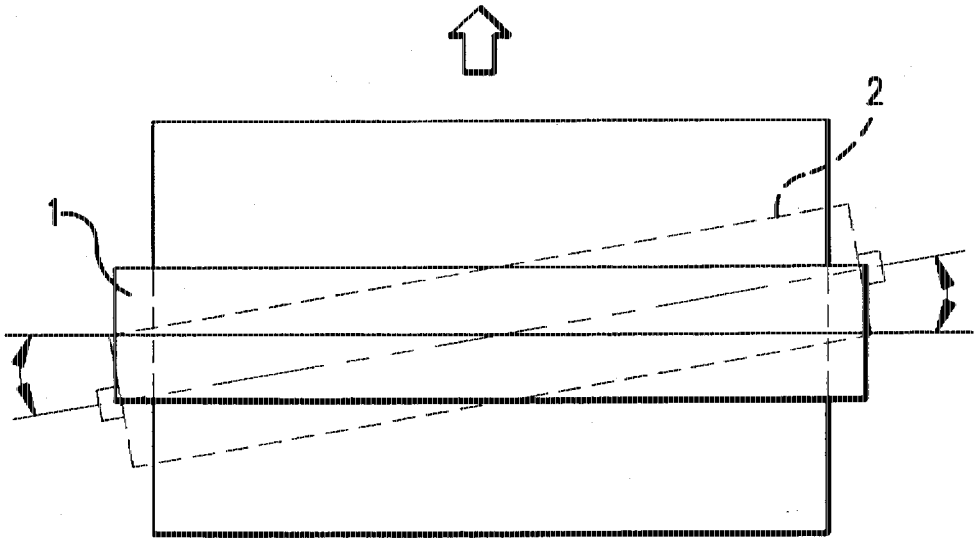
FIG. 16 is a schematic sectional view of a fixing device of the present invention.
Figure 17:
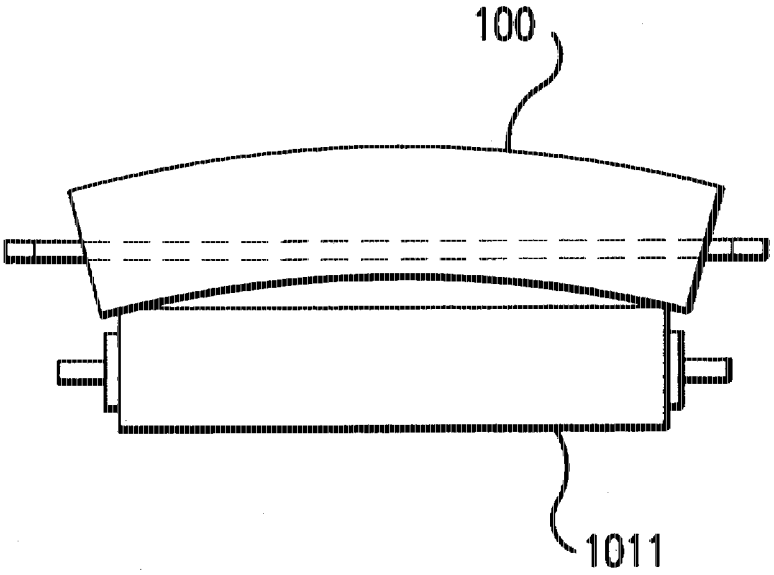
FIG. 17 is a perspective view in which a fixing roller is bent.
Figure 18:
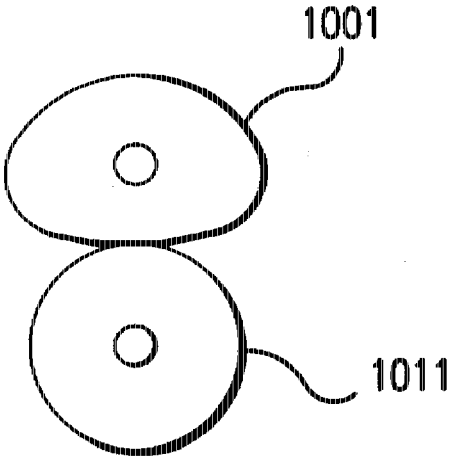
FIG. 18 is a perspective front view in which a fixing roller is squashed.

With respect to each of the embodiments described herein, because the cylindrical metal core 10 is thin, a pressing force of the pressure roller 2 is restricted so not to distort the shape of fixing roller 1. Accordingly, even when the fixing roller 1 and the pressure roller 2, due to a slight misalignment, cross at a middle of each roller about 1° to 2° as shown in FIGS. 15 and 16, a reinforcing device 12 positioned at the crossing portion prevents fixing roller 1 from deforming. The positioning of reinforcing device 12 is particularly important when there is a slight misalignment of fixing roller 1 and pressure roller 2 because the pressure exerted by pressure roller 2 tends to be concentrated at its crossing point with fixing roller 1.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A fixing device for fixing an image on recording paper, comprising:

a fixing roller including a thin cylindrically shaped core and a heater;

a pressure roller held in pressured contact against said fixing roller; and reinforcing means for preserving the cylindrical shape of said core, said reinforcing means comprising a circular plate having a contacting portion held in contact with the inner surface of the cylindrically shaped core, said reinforcing means further comprising extending said thin cylindrically shaped core to form a shoulder connecting said thin cylindrically shaped core and a surface parallel to an axis of the cylindrical shape and having a diameter smaller than that of said cylindrically shaped core.

2. A fixing device as claimed in claim 1, wherein said contacting member includes at least one slit.

3. A fixing device as claimed in claim 2, wherein a width of said slit is smaller than that of said contacting portion of said contacting member.

4. A fixing device as claimed in claim 1, wherein said reinforcing means is positioned at a middle of said fixing roller and at both sides of said fixing roller with respect to an axial direction of said fixing roller.

5. A fixing device as claimed in claim 1, wherein said fixing roller is supported by a bearing at said smaller diameter surface.

6. A fixing device as claimed in claim 1, wherein said smaller diameter surface is thicker in cross-section than a wall of said cylindrically shaped core.

7. A fixing device as claimed in claim 1, wherein both sides of said fixing roller have said shoulder to form two reinforcing members with respect to said axial direction of said smaller diameter surfaces.

8. A fixing device as claimed in claim 1, wherein said reinforcing means is made of a material that is the same as that of said cylindrically shaped core.

9. A fixing device as claimed in claim 1, wherein said reinforcing means is thicker in cross-section than a wall of said cylindrically shaped core.

10. A fixing device as claimed in claim 9, wherein a thickness $t_{ri}$ of said reinforcing means and a thickness $t_{rO}$ of said cylindrical core satisfy the equation $$t_{rO} \leqq t_{ri} \leqq 3t_{rO}.$$

11. A fixing device as claimed in claim 1, wherein said heater includes a heating portion, and said reinforcing means is provided at a middle and at both ends of said cylindrically shaped core, said heating portion positioned between the both ends of said reinforcing means with respect to said axial direction.

12. A fixing device as claimed in claim 1, wherein said fixing roller and said pressure roller cross each other at a crossing point.

13. A fixing device for fixing an image on recording paper, comprising:

a fixing roller including a cylindrically shaped core and a heater;

a pressure roller held in pressured contact against said fixing roller; and a circular plate having a contacting portion held in contact with the inner surface of the cylindrically shaped core for reinforcing and preserving the cylindrical shape of said core, wherein a specific heat capacity of said circular plate is less than that of a specific heat capacity of said cylindrical core.

14. A fixing device for fixing an image on recording paper, comprising:

a fixing roller including a cylindrically shaped core and a heater;

a pressure roller held in pressured contact against said fixing roller; and a circular plate having a contacting portion held in contact with the inner surface of the cylindrically shaped core for reinforcing and preserving the cylindrical shape of said core, wherein a thickness of said cylindrically shaped core $t_{rO}$ satisfies the equation:

$$t_{rO} > 3 \times \sigma_{th} \times D_{in} / (2 \times \sigma_s)$$

where $\sigma_{th}$ denotes a thermal stress of the reinforcing means, $t_{rO}$ denotes a thickness of said cylindrical core, $D_{in}$ denotes an inner diameter of said cylindrical core, and $\sigma_s$ denotes a yield stress of said cylindrical core.

15. A fixing roller comprising:

a cylindrically shaped core and a heater;

a pressure roller held in pressured contact against said fixing roller; and reinforcing means for preserving the cylindrical shape of said core, said reinforcing means comprising a circular plate having a contacting portion held in contact with the inner surface of the cylindrically shaped core, said reinforcing means further comprising a shoulder connecting said cylindrically shaped core to a surface parallel to an axis of the cylindrical shape and having a diameter smaller than that of said cylindrically shaped core.

16. A fixing roller comprising:

a cylindrically shaped core and a heater;

a pressure roller held in pressured contact against said fixing roller; and a circular plate having a contacting portion held in contact with the inner surface of the cylindrically shaped core for reinforcing and preserving the cylindrical shape of said core, wherein a specific heat capacity of said circular plate is less than that of a specific heat capacity of said cylindrical core.

17. A fixing roller comprising:

a cylindrically shaped core and a heater;

a pressure roller held in pressured contact against said fixing roller; and a circular plate having a contacting portion held in contact with the inner surface of the cylindrically shaped core for reinforcing and preserving the cylindrical shape of said core, wherein a thickness of said cylindrically shaped core $t_{rO}$ satisfies the equation:

$$t_{rO}>3\times\sigma_{th}\times D_{in}/(2\times\sigma_s)$$

where $\sigma_{th}$ denotes a thermal stress of the reinforcing means, $t_{rO}$ denotes a thickness of said cylindrical core, $D_{in}$ denotes an inner diameter of said cylindrical core, and $\sigma_s$ denotes a yield stress of said cylindrical core.

18. An image forming apparatus for forming an image on a sheet of paper, comprising:

a fixing roller including a cylindrically shaped core and a heater;

a pressure roller held in pressured contact against said fixing roller; and reinforcing means for preserving the cylindrical shape of said core, said reinforcing means comprising a circular plate having a contacting portion held in contact with the inner surface of the cylindrically shaped core, said reinforcing means further comprising a shoulder connecting said cylindrically shaped core to a surface parallel to an axis of the cylindrical shape and having a diameter smaller than that of said cylindrically shaped core.

19. An image forming apparatus for forming an image on a sheet of paper, comprising:

a fixing roller including a cylindrically shaped core and a heater;

a pressure roller held in pressured contact against said fixing roller; and a circular plate having a contacting portion held in contact with the inner surface of the cylindrically shaped core for reinforcing and preserving the cylindrical shape of said core, wherein a specific heat capacity of said circular plate is less than that of a specific heat capacity of said cylindrical core.

20. An image forming apparatus for forming an image on a sheet of paper, comprising:

a fixing roller including a cylindrically shaped core and a heater;

a pressure roller held in pressured contact against said fixing roller; and a circular plate having a contacting portion held in contact with the inner surface of the cylindrically shaped core for reinforcing and preserving the cylindrical shape of said core, wherein a thickness of said cylindrically shaped core $t_{rO}$ satisfies the equation:

$$t_{rO}>3\times\sigma_{th}\times D_{in}/(2\times\sigma_s)$$

where $\sigma_{th}$ denotes a thermal stress of the reinforcing means, $t_{rO}$ denotes a thickness of said cylindrical core, $D_{in}$ denotes an inner diameter of said cylindrical core, and $\sigma_s$ denotes a yield stress of said cylindrical core.

21. A fixing device for fixing an image on recording paper, comprising:

a heat emitting fixing roller including a thin cylindrically shaped core whose inner surface has a cylindrical shape;

a pressure roller held in pressured contact against said fixing roller; and a reinforcing device having a circular plate and a contacting portion which is extended at an angle of substantially 90° from an outer edge of said circular plate portion along the inner surface of said cylindrically shaped core.

* * * * *